US008957590B1

(12) United States Patent
Peng

(10) Patent No.: US 8,957,590 B1
(45) Date of Patent: Feb. 17, 2015

(54) STRUCTURE OF COLOR MIXTURE SYNCHRONIZATION CIRCUIT OF LED LIGHT STRING

(71) Applicant: Mei-Ling Peng, Hsinchu (TW)

(72) Inventor: Mei-Ling Peng, Hsinchu (TW)

( * ) Notice: Subject to any disclaimer, the term of this patent is extended or adjusted under 35 U.S.C. 154(b) by 23 days.

(21) Appl. No.: 13/968,417

(22) Filed: Aug. 15, 2013

(51) Int. Cl.
*H05B 39/00* (2006.01)

(52) U.S. Cl.
USPC ..... 315/185 S; 315/209 R; 315/224; 315/291; 315/312

(58) Field of Classification Search
USPC ..... 315/185 S, 209 R, 224, 225, 307–326
See application file for complete search history.

(56) References Cited

U.S. PATENT DOCUMENTS 7,847,487 B2 * 12/2010 Kato ..... 315/192
8,354,800 B2 * 1/2013 Stack ..... 315/250
2006/0038542 A1 * 2/2006 Park et al. ..... 323/229
2007/0216322 A1 * 9/2007 Kim ..... 315/312
2008/0218095 A1 * 9/2008 Erhardt ..... 315/224
2012/0217886 A1 * 8/2012 Cho et al. ..... 315/192
2013/0181633 A1 * 7/2013 Deppe et al. ..... 315/239
2014/0145630 A1 * 5/2014 Peng ..... 315/192

* cited by examiner

*Primary Examiner* — Tuyet Thi Vo
(74) *Attorney, Agent, or Firm* — Leong C. Lei

(57) ABSTRACT

Disclosed is a structure of a color mixture synchronization circuit of an LED light string. The LED light string includes a plurality of LED lights each of which has two input pins that are respectively an input pin of two light emitting chips of four primary color light emitting chips of R, G, B, and Y that are connected in parallel and opposite in direction and an input pin of the remaining two light emitting chips that are connected in parallel and opposite in direction; and two output pins that are respectively an output pin of the two light emitting chips of the four primary color light emitting chips of R, G, B, and Y that are connected in parallel and opposite in direction and an output pin of the remaining two light emitting chips that are connected in parallel and opposite in direction.

7 Claims, 5 Drawing Sheets

STRUCTURE OF COLOR MIXTURE SYNCHRONIZATION CIRCUIT OF LED LIGHT STRING

(a) TECHNICAL FIELD OF THE INVENTION

The present invention generally relates to a structure of a color mixture synchronization circuit of an LED light string, and more particularly to an electrical connection structure of four primary color light emitting chips of R (Red), G (Green), B (Blue), and Y (Yellow) of each LED light of an LED light string that allows the LEG lights to be connected in series to form the LED light string.

(b) DESCRIPTION OF THE PRIOR ART

In the known techniques of an LED light string of LED lights that use color light emitting chips, the structure of electrical connection among four primary color light emitting chips of R, G, B, and Y of each LED light of the LED light string is often a parallel connection structure of common cathode or common anode. In uses, they are all connected in series and the shortcomings are (1) that the electrical current of the light string is large, making it not possible to apply to light strings that are of a large number of lights; (2) that no high voltage is feasible; and (3) that the light string requires four wires, leading to a waste of cost. An alternative arrangement is that each of the lights is provided with an IC; however, such as light string is incapable of synchronous color change and adding an IC in each light also lead to an increase of cost. Thus, the LED lights of a conventional light string capable of synchronous color change of the LEDs are connected in parallel, as shown in FIGS. 1 and 2. The parallel connection makes each LED light of the LED string connected through four terminals in combination with eight wires to form the LED string. In this way, both size and weight of the light string get large and the manufacture cost is also increased.

SUMMARY OF THE INVENTION

To overcome the technical drawbacks that the known techniques allow only connection of a plurality of LED lights in parallel to form an LED light string, making it not possible to achieve synchronous color change of the primary color light emitting chips of each LED light, and a light string so formed is of increased size and weight, leading to a substantial increase of manufacture cost, the present invention provides a novel electrical connection structure of light emitting chips of an LED light that allows a plurality of LED lights to be connected in series to form an LED light string so as to reduce the number of IC control chips used and realize synchronous color change of the light emitting chips.

The technical solution adopted in the present invention is that each one of LED lights of an LED light string is provided with two input pins and two output pins. The two input pins are respectively an input pin of any two light emitting chips of four primary color light emitting chips of R, G, B, and Y that are connected in parallel and opposite in direction and an input pin of the remaining two light emitting chips that are connected in parallel and opposite in direction. The two output pins are respectively an output pin of any two light emitting chips of the four primary color light emitting chips of R, G, B, and Y that are connected in parallel and opposite in direction and an output pin of the remaining two light emitting chips that are connected in parallel and opposite in direction. Thus, each of the LED lights of the LED light string is connected in series, in a two-input-two-output arrangement with two terminals in combination with four wires, to form a light string. The advantage of the present invention is that the structure is simple and realizes series connection of a group of LED lights with a minimum number of connection wires, reduction of the number of IC control chips and synchronous color change of the light emitting chips through only modifications made in the electrical connection arrangement of the four primary color light emitting chips of R, G, B, and Y.

The advantage of the present invention is that the structure is simple and realizes reduction of the number of IC control chips and synchronous color change of the light emitting chips in applications where a group of LED light strings are connected in series through only modifications made in the electrical connection arrangement of the four primary color light emitting chips of R, G, B, and Y.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
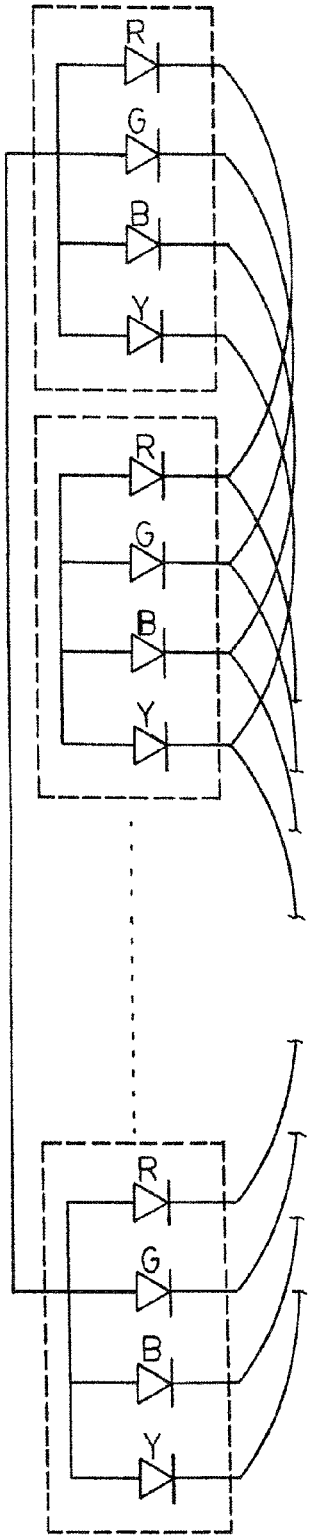
FIG.1 PRIOR ART
FIG. 1 is a circuit diagram illustrating a conventional common anode connection of an LED light of an LEG light string.
Figure 2:
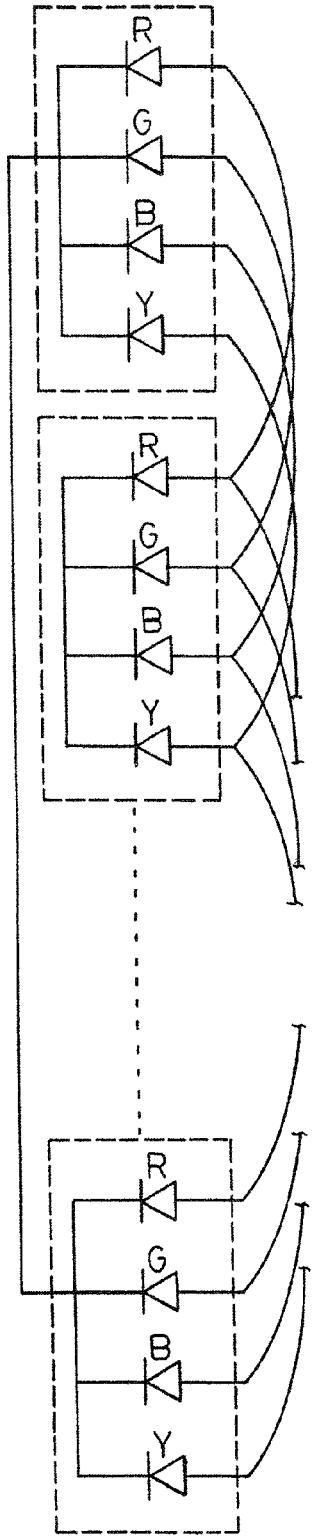
FIG.2 PRIOR ART
FIG. 2 is a circuit diagram illustrating a conventional common cathode connection of an LED light of an LEG light string.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to the drawings, the present invention provides a structure of a color mixture synchronization circuit of an LED light string, which is characterized in that each of the LED lights (20) of the light string is provided with two input pins and two output pins. The two input pins are respectively an input pin of any two light emitting chips of the four primary color light emitting chips of R, G, B, and Y that are connected in parallel and opposite in direction and an input pin of the remaining two light emitting chips that are connected in parallel and opposite in direction. The two output pins are respectively an output pin of the two light emitting chips of the four primary color light emitting chips of R, G, B, and Y that correspond to one of the input pins and are connected in parallel and opposite in direction and an output pin of the remaining two light emitting chips that correspond to another one of the input pins and are connected in parallel and opposite in direction. Thus, each of the LED lights of the LED light string can be connected in series, in a two-input-two-output arrangement with two terminals in combination with four wires (11), (12), (13), (14), to form a light string. The advantage of the present invention is that the structure is simple and realizes series connection of a group of LED lights with a minimum number of connection wires, reduction of the number of IC control chips and synchronous color change of the light emitting chips through only modifications made in the electrical connection arrangement of the four primary color light emitting chips of R, G, B, and Y.

Figure 3:
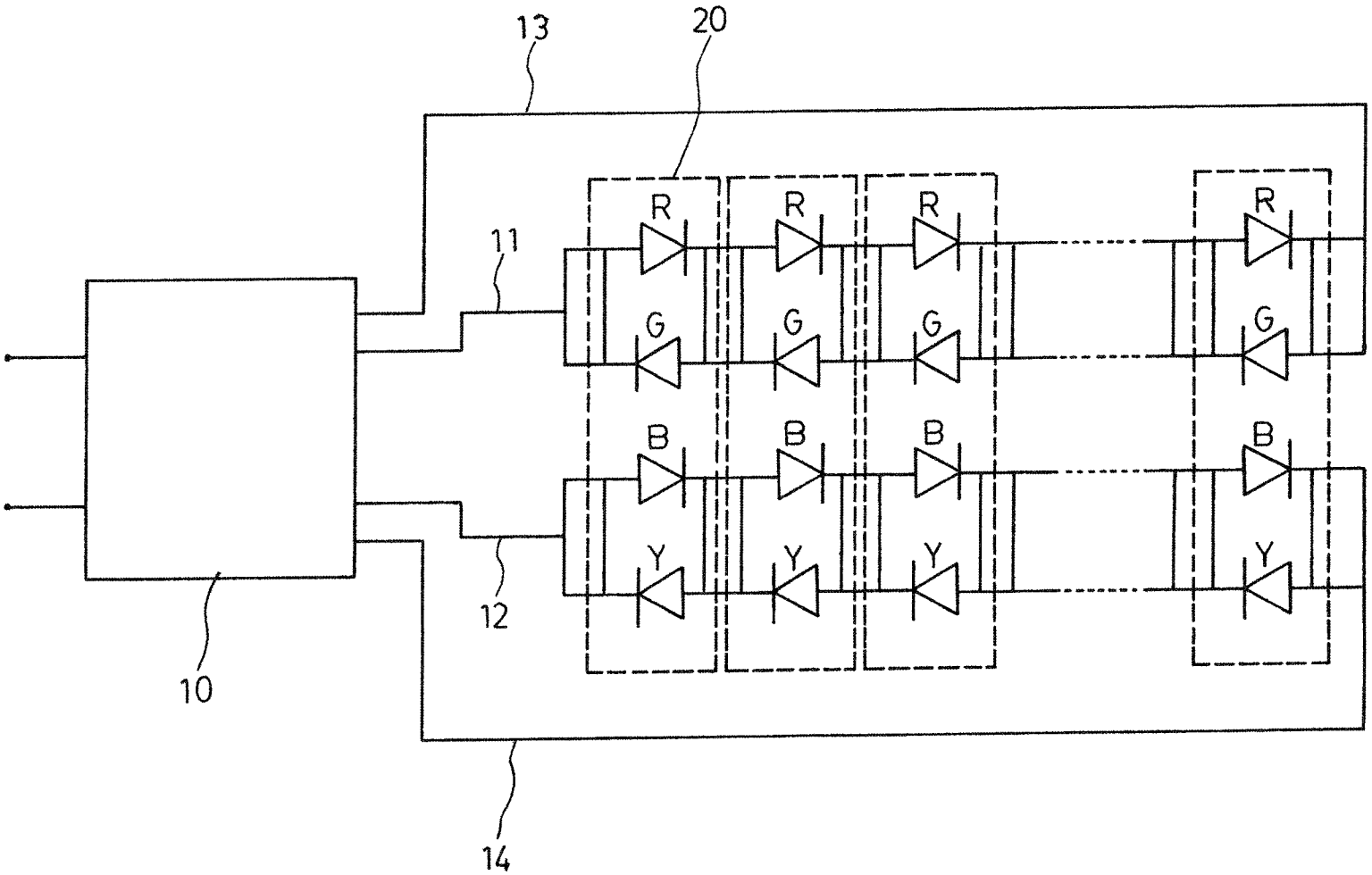
FIG. 3 is a circuit diagram illustrating serial connection of LED lights of an LED light string according to a first embodiment of the present invention.

Referring to FIG. 3, the connection structure of the four primary color light emitting chips of R, G, B, and Y of each of LED lights (20) of an LED light string according to a first embodiment of the present invention is that the two input pins are respectively an input pin of parallel-connected anode of the R primary color light emitting chip and cathode of the G primary color light emitting chip and an input pin of parallel-connected anode of the B primary color light emitting chip and cathode of the Y primary color light emitting chip; and the two output pins are respectively an output pin of parallel-connected cathode of the R primary color light emitting chip and anode of the G primary color light emitting chip and an output pin of parallel-connected cathode of the B primary color light emitting chip and anode of the Y primary color light emitting chip. The LED light string comprises a controller (10) that is provided with four wires (11), (12), (13), (14), of which the wires (11), (12) each have an end connected to the controller (10) and an opposite end electrically connected to an input contact of the LED lights (20) and the wires (13), (14) each have an end connected to the controller (10) and an opposite end electrically connected to an output contact of the LED lights (20). As such, each of the LED lights (20) of the LED light string is electrically connected in series, in a two-input-two-output arrangement with two terminals in combination with four wires, to form a light string.

Figure 4:
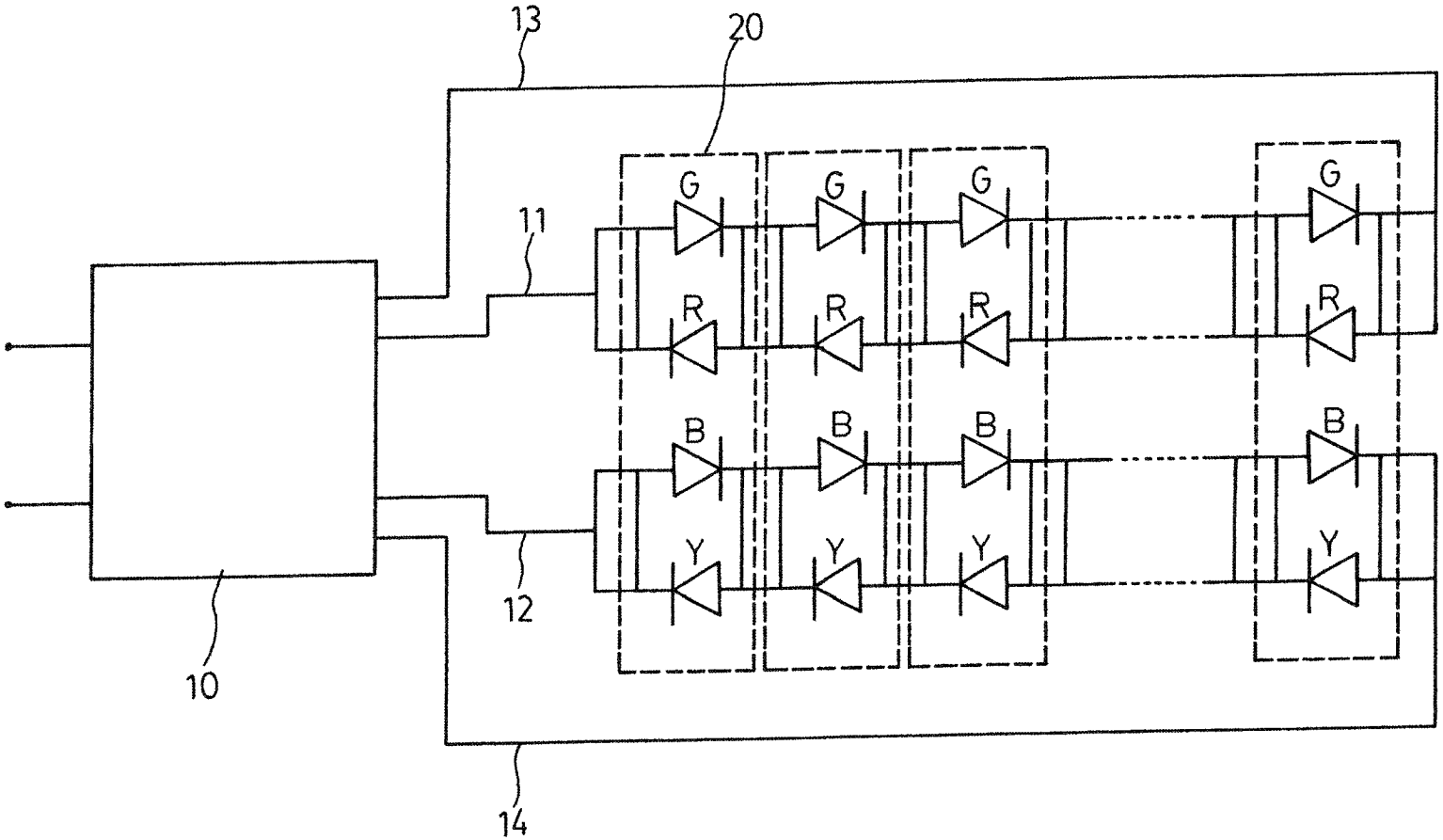
FIG. 4 is a circuit diagram illustrating serial connection of LED lights of an LED light string according to a second embodiment of the present invention.

Referring to FIG. 4, the connection structure of the four primary color light emitting chips of R, G, B, and Y of each of LED lights (20) of an LED light string according to a second embodiment of the present invention is that the two input pins are respectively an input pin of parallel-connected anode of the G primary color light emitting chip and cathode of the R primary color light emitting chip and an input pin of parallel-connected anode of the B primary color light emitting chip and cathode of the Y primary color light emitting chip; and the two output pins are respectively an output pin of parallel-connected cathode of the G primary color light emitting chip and anode of the R primary color light emitting chip and an output pin of parallel-connected cathode of the B primary color light emitting chip and anode of the Y primary color light emitting chip. The LED light string comprises a controller (10) that is provided with four wires (11), (12), (13), (14), of which the wires (11), (12) each have an end connected to the controller (10) and an opposite end electrically connected to an input contact of the LED lights (20) and the wires (13), (14) each have an end connected to the controller (10) and an opposite end electrically connected to an output contact of the LED lights (20). As such, each of the LED lights (20) of the LED light string is electrically connected in series, in a two-input-two-output arrangement with two terminals in combination with four wires, to form a light string.

Figure 5:
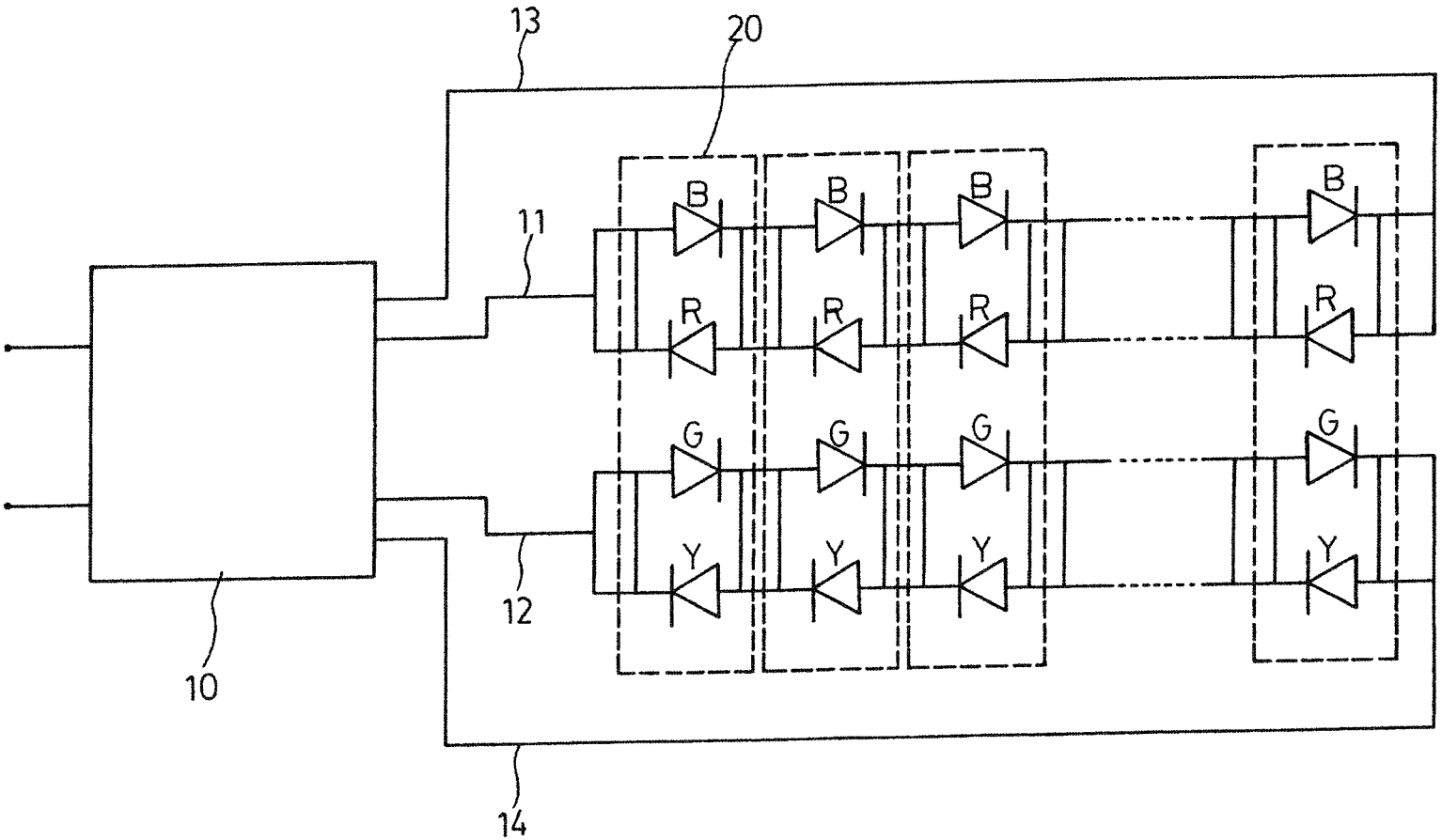
FIG. 5 is a circuit diagram illustrating serial connection of LED lights of an LED light string according to a third embodiment of the present invention.

Referring to FIG. 5, the connection structure of the four primary color light emitting chips of R, G, B, and Y of each of LED lights (20) of an LED light string according to a third embodiment of the present invention is that the two input pins are respectively an input pin of parallel-connected anode of the B primary color light emitting chip and cathode of the R primary color light emitting chip and an input pin of parallel-connected anode of the G primary color light emitting chip and cathode of the Y primary color light emitting chip; and the two output pins are respectively an output pin of parallel-connected cathode of the B primary color light emitting chip and anode of the R primary color light emitting chip and an output pin of parallel-connected cathode of the G primary color light emitting chip and anode of the Y primary color light emitting chip. The LED light string comprises a controller (10) that is provided with four wires (11), (12), (13), (14), of which the wires (11), (12) each have an end connected to the controller (10) and an opposite end electrically connected to an input contact of the LED lights (20) and the wires (13), (14) each have an end connected to the controller (10) and an opposite end electrically connected to an output contact of the LED lights (20). As such, each of the LED lights (20) of the LED light string is electrically connected in series, in a two-input-two-output arrangement with two terminals in combination with four wires, to form a light string.

Figure 6:
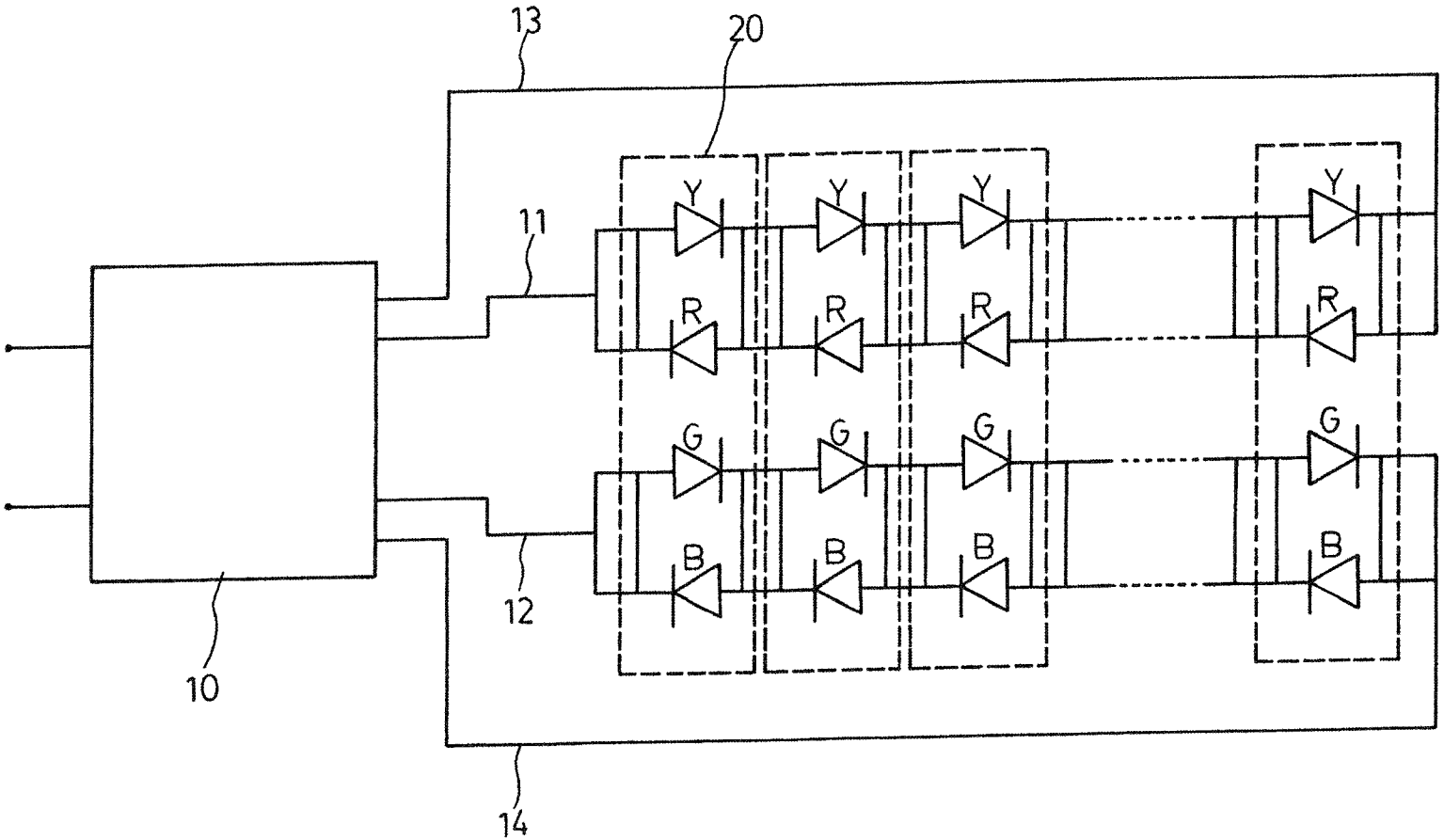
FIG. 6 is a circuit diagram illustrating serial connection of LED lights of an LED light string according to a fourth embodiment of the present invention.

Referring to FIG. 6, the connection structure of the four primary color light emitting chips of R, G, B, and Y of each of LED lights (20) of an LED light string according to a fourth embodiment of the present invention is that the two input pins are respectively an input pin of parallel-connected anode of the Y primary color light emitting chip and cathode of the R primary color light emitting chip and an input pin of parallel-connected anode of the G primary color light emitting chip and cathode of the B primary color light emitting chip; and the two output pins are respectively an output pin of parallel-connected cathode of the Y primary color light emitting chip and anode of the R primary color light emitting chip and an output pin of parallel-connected cathode of the G primary color light emitting chip and anode of the B primary color light emitting chip. The LED light string comprises a controller (10) that is provided with four wires (11), (12), (13), (14), of which the wires (11), (12) each have an end connected to the controller (10) and an opposite end electrically connected to an input contact of the LED lights (20) and the wires (13), (14) each have an end connected to the controller (10) and an opposite end electrically connected to an output contact of the LED lights (20). As such, each of the LED lights (20) of the LED light string is electrically connected in series, in a two-input-two-output arrangement with two terminals in combination with four wires, to form a light string.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a color mixture synchronization circuit of an LED light string, characterized in that each of LED lights of an LED light string comprises two input pins and two output pins, wherein the two input pins are respectively an input pin of two light emitting chips of four primary color light emitting chips of R, G, B, and Y that are connected in parallel and opposite in direction and an input pin of the remaining two light emitting chips that are connected in parallel and opposite in direction; and the two output pins are respectively an output pin of the two light emitting chips of the four primary color light emitting chips of R, G, B, and Y that correspond to one of the input pins and are connected in parallel and opposite in direction and an output pin of the remaining two light emitting chips that correspond to another one of the input pins and are connected in parallel and opposite in direction, whereby each of the LED lights of the LED light string is connected in series, in a two-input-two-output arrangement with two terminals in combination with four wires, to form a light string.

2. The structure of a color mixture synchronization circuit of an LED light string according to claim 1, wherein the two input pins of each of the LED lights are respectively an input pin of parallel-connected anode of the R primary color light emitting chip and cathode of the G primary color light emitting chip and an input pin of parallel-connected anode of the B primary color light emitting chip and cathode of the Y primary color light emitting chip; and the two output pins are respectively an output pin of parallel-connected cathode of the R primary color light emitting chip and anode of the G primary color light emitting chip and an output pin of parallel-connected cathode of the B primary color light emitting chip and anode of the Y primary color light emitting chip.

3. The structure of a color mixture synchronization circuit of an LED light string according to claim 1, wherein the two input pins of each of the LED lights are respectively an input pin of parallel-connected anode of the G primary color light emitting chip and cathode of the R primary color light emitting chip and an input pin of parallel-connected anode of the B primary color light emitting chip and cathode of the Y primary color light emitting chip; and the two output pins are respectively an output pin of parallel-connected cathode of the G primary color light emitting chip and anode of the R primary color light emitting chip and an output pin of parallel-connected cathode of the B primary color light emitting chip and anode of the Y primary color light emitting chip.

4. The structure of a color mixture synchronization circuit of an LED light string according to claim 1, wherein the two input pins of each of the LED lights are respectively an input pin of parallel-connected anode of the B primary color light emitting chip and cathode of the R primary color light emitting chip and an input pin of parallel-connected anode of the G primary color light emitting chip and cathode of the Y primary color light emitting chip; and the two output pins are respectively an output pin of parallel-connected cathode of the B primary color light emitting chip and anode of the R primary color light emitting chip and an output pin of parallel-connected cathode of the G primary color light emitting chip and anode of the Y primary color light emitting chip.

5. The structure of a color mixture synchronization circuit of an LED light string according to claim 1, wherein the two input pins of each of the LED lights are respectively an input pin of parallel-connected anode of the G primary color light emitting chip and cathode of the R primary color light emitting chip and an input pin of anode of the B primary color light emitting chip; and the two output pins are respectively an output pin of parallel-connected cathode of the G primary color light emitting chip and anode of the R primary color light emitting chip and an output pin of cathode of the B primary color light emitting chip.

6. The structure of a color mixture synchronization circuit of an LED light string according to claim 1, wherein the two input pins of each of the LED lights are respectively an input pin of parallel-connected anode of the B primary color light emitting chip and cathode of the R primary color light emitting chip and an input pin of anode of the G primary color light emitting chip; and the two output pins are respectively an output pin of parallel-connected cathode of the B primary color light emitting chip and anode of the R primary color light emitting chip and an output pin of cathode of the G primary color light emitting chip.

7. The structure of a color mixture synchronization circuit of an LED light string according to claim 1, wherein the two input pins of each of the LED lights are respectively an input pin of parallel-connected anode of the Y primary color light emitting chip and cathode of the R primary color light emitting chip and an input pin of parallel-connected anode of the G primary color light emitting chip and cathode of the B primary color light emitting chip; and the two output pins are respectively an output pin of parallel-connected cathode of the T primary color light emitting chip and anode of the R primary color light emitting chip and an output pin of parallel-connected cathode of the G primary color light emitting chip and anode of the B primary color light emitting chip.

* * * * *